US005211992A

United States Patent [19]

Newton et al.

[11] Patent Number: 5,211,992

[45] Date of Patent: May 18, 1993

[54] METHOD AND APPARATUS FOR COATING ARTICLES

[75] Inventors: Philip G. Newton, Kirrawee; Patrick W. Duggan, Kew; Hugo Dries, Mount Macedon, all of Australia

[73] Assignee: International Partners in Glass Research, Windsor, Conn.

[21] Appl. No.: 656,224

[22] Filed: Feb. 14, 1991

[30] Foreign Application Priority Data

Feb. 16, 1990 [AU] Australia ..... PJ8688

[51] Int. Cl.[5] ..... B05D 3/02; B05D 3/06; B05D 1/18

[52] U.S. Cl. ..... 427/512; 427/314; 427/348; 427/430.1; 427/443.2; 118/423; 118/503; 118/DIG. 3

[58] Field of Search ..... 118/423, 503, DIG. 3; 427/314, 372.2, 430.1, 54.1, 443.2, 512, 348; 198/377

[56] References Cited

U.S. PATENT DOCUMENTS

| | | | |
|---|---|---|---|
| 1,075,546 | 10/1913 | Burpee | 198/377 |
| 2,380,968 | 8/1945 | Kimmig | 118/423 X |
| 2,541,574 | 2/1951 | Crooks | 118/DIG. 3 |
| 3,200,002 | 8/1965 | Lusher | 427/443.2 |
| 3,253,943 | 5/1966 | Mayer | 118/423 X |
| 3,270,710 | 9/1966 | Johnson et al. | 118/56 |
| 3,734,765 | 5/1973 | Russell | 118/423 X |
| 3,811,921 | 5/1974 | Crawford et al. | 427/389.7 |
| 3,898,355 | 8/1975 | Okeley, II et al. | 427/443.2 |
| 3,914,466 | 10/1975 | Ohkuma | 427/443.2 |
| 3,968,279 | 7/1976 | Brown et al. | 427/348 |
| 4,022,155 | 5/1977 | Campagna et al. | 118/423 |
| 4,232,058 | 11/1980 | Dow et al. | 427/443.2 |
| 4,310,566 | 1/1982 | McGrath | 427/443.2 |
| 4,623,559 | 11/1986 | Hudock | 427/430.1 X |
| 5,092,266 | 3/1992 | Kuo | 118/503 |

FOREIGN PATENT DOCUMENTS

| | | |
|---|---|---|
| 0071235 | 2/1983 | European Pat. Off. . |
| 3033297 | 4/1982 | Fed. Rep. of Germany . |
| 1037013 | 9/1953 | France . |
| 782990 | 9/1957 | United Kingdom . |

*Primary Examiner*—Shrive Beck
*Assistant Examiner*—Diana L. Dudash
*Attorney, Agent, or Firm*—Burns, Doane, Swecker & Mathis

[57] ABSTRACT

A method and apparatus is provided for coating exterior surfaces of glass containers such as bottles. The containers are conveyed along a coating path by conveying means so that the containers are arranged in a non-contact relationship with one another. A coating vessel is provided for containing a bath of liquid coating material M. The conveying means is arranged to dip containers being conveyed at least partially into the bath of liquid coating material so as to apply a coating of material to exterior surfaces of the containers. Setting means operates to set the coating applied to the containers. The method and apparatus may be incorporated into a continuous container manufacturing line so that the containers to be coated are continuously received from a lehr conveyor for conveying along the coating path by the conveying means.

1 Claim, 9 Drawing Sheets

FIG. 8
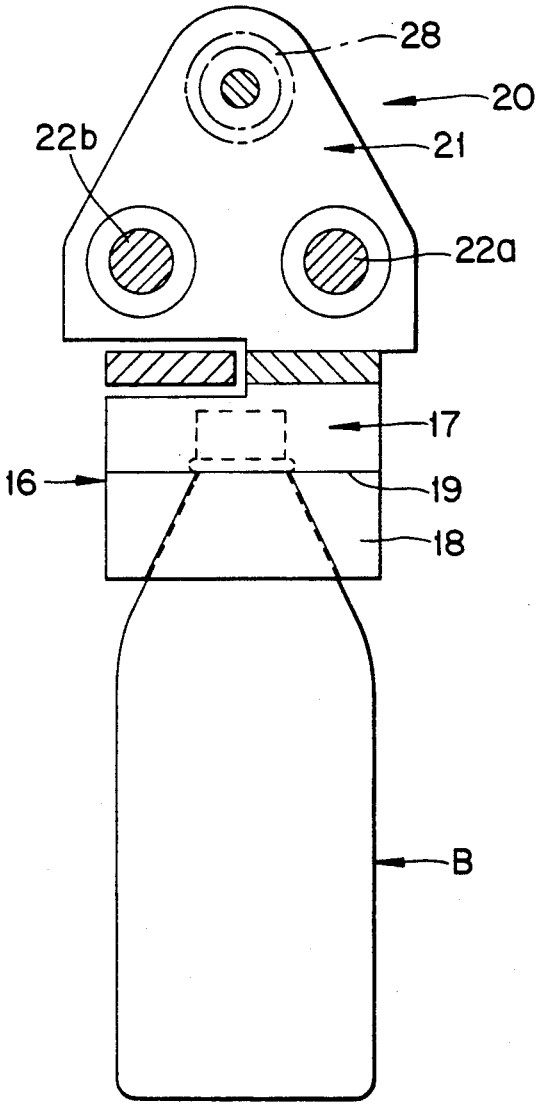
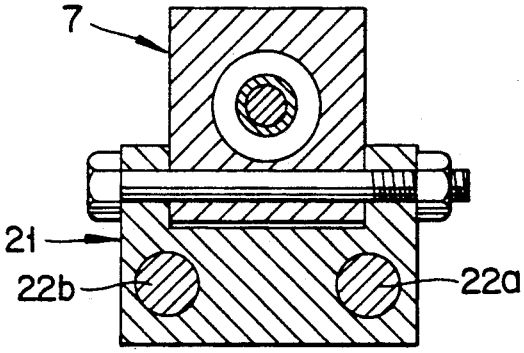
FIG. 9

METHOD AND APPARATUS FOR COATING ARTICLES

BACKGROUND OF THE INVENTION

1. Field of the Invention

This invention relates generally to the application of a coating to an exterior surface of articles, and in particular to a method and apparatus for dip coating fragile articles with a polymer material in order to increase their dynamical strength. The invention is applicable to glass articles such as bottles and other containers in order to increase their resistance and impact strengths against breakage, and it will be convenient to hereinafter describe the invention in relation to that exemplary application. It is to be appreciated, however, that the invention is not limited to that application.

2. Description of the Related Art

Glass bottles, jars and other containers suffer commercial disadvantages from being composed of relatively fragile material. In that regard, such containers are readily susceptible to breakage by external impact and by internal pressure of a fluid filled therein under pressure. This susceptibility is particularly evident during filling, packaging and transportation of the containers through trade channels to the end consumer, and generally requires the adoption of special procedures for careful handling of the containers to minimise breakage. Such procedures have an adverse influence on the cost of the containers and, ultimately, their contents.

Various packaging arrangements have been developed to minimise the susceptibility of container breakage. However, such packaging does not affect individual unpackaged containers.

Proposals have also been made to protect individual containers through the application of external protective films or coatings which act to absorb impact forces and prevent scattering of glass fragments on breakage of the containers. Such coatings have included films and sleeves of resilient plastics material. Several such proposals are discussed in Australian patent application 15269/88, which patent application goes on to disclose in detail a coating material as well as an outline of a procedure for applying the material.

The coating material disclosed in this earlier application has been found to improve the strength of glass containers. However, difficulties arise in achieving an acceptable coating of the containers, at least on a commercial scale. Proposals to date for coating methods involve off-line application of the coating material, i.e. coating the containers in a separate operation after their initial manufacture. Such proposals add to the handling of the containers, and hence their overall manufacturing cost.

SUMMARY OF THE INVENTION

It is an object of the present invention to provide a relatively simple method and apparatus for economical application of a protective coating to an exterior surface of fragile articles, such as glass bottles and other glass containers.

It is another object of the present invention to provide a method and apparatus for applying a protective coating to fragile articles and which are particularly suitable for integration into conventional manufacturing processes for those articles.

With these objects in mind, one aspect of the present invention provides a method for coating exterior surfaces of glass containers, including: conveying the containers along a coating path so that the containers are arranged in a non-contact relationship with one another; dipping the containers being conveyed at least partially into a bath of liquid coating material so as to apply a coating of material to exterior surfaces of the containers; and, setting the coating applied to the containers.

Preferably, conveying the containers includes gripping the containers at an upper region to hold them in stable suspension. Those gripped containers are then moved downwardly into the bath of liquid coating material against buoyancy forces applied to the containers by the coating material. Subsequently, the containers are moved upwardly out of the bath of liquid coating material. Moving the gripped containers out of the bath of liquid coating material preferably includes initially relatively rapidly withdrawing the containers until about two-thirds of the bottle height being coated is withdrawn from the bath of coating material. The containers are then more slowly withdrawn until they are finally withdrawn from the bath of liquid coating material.

Preferably, conveying the containers further includes maintaining them in stable suspension during setting of at least part of the coating. In that regard, the containers may be released after a part of the applied coating has been set, and supporting the containers on the set part of the coating during continued conveying. Alternatively, the containers may be maintained in stable suspension throughout setting of the coating.

Conveying the containers along the coating path is preferably continuous throughout the coating method, including during container dipping and coating setting. Moreover, the coating path is preferably adjustable so as to vary the extent of container dipping and coating setting.

Preferably, dipping of the containers includes only partially immersing them in the bath of liquid coating material. In this way, a coating is applied to only the immersed part of the containers. Those containers are preferably continuously moved through the liquid coating material.

Setting of the coating may be achieved through a variety of techniques, at least to some extent depending on the composition of the liquid coating material used. Setting the coating achieves solidifying and hardening of the coating.

Setting of the coating can comprise or include curing the liquid coating material applied to the containers so that the coating becomes hard and solid.

Preferably, curing the coating includes subjecting the coating material to irradiation with electro-magnetic radiation. The irradiation may be ultraviolet light radiation.

Curing of the coating may be single or multi-stage curing. In a multi-stage curing, a part of the coating is preferably cured during a first curing stage and a remaining part of the coating is then cured during a second curing stage. The first stage curing preferably occurs during gripping of the containers, whilst the second stage curing occurs after release of the containers and during support of the containers on the cured part of the coating. In an alternative single stage curing, the entire coating is cured during gripping of the containers.

Setting of the coating can comprise or include heating the coating applied to the containers in order to remove volatile ingredients. This heating may achieve drying or thermal aging of the coating material. Heating of the coating may be used in conjunction with curing of the coating as outlined above, where that occurs, heating will preferably, precede the curing of the coating in order to thermally age the coating. Alternatively, heating may be used along or in conjunction with other procedures.

Preferably, heating of the coating includes subjecting the coating material to heated gas and/or using preheated containers.

Preferably, the method is incorporated into a continuous container manufacturing line. With this arrangement the containers are continuously received from a lehr conveyor for conveying along the coating path.

In another aspect, the present invention provides an apparatus for coating exterior surfaces of glass containers, including: conveying means defining a coating path and operable to convey containers along the coating path so that the containers are arranged in a non-contact relationship with one another; a coating vessel for containing a bath of liquid coating material, the conveying means being arranged to dip containers being conveyed thereby along the coating path at least partially into the coating material to apply a coating of material to exterior surfaces of the containers; and, setting means for setting the coating material applied to the containers.

Preferably, the conveying means includes at least one pick-up mechanism for releasably gripping the containers at an upper region. The containers are held in stable suspension from the pick-up mechanism. The pick-up mechanism is preferably movable along a conveying path to convey the gripped containers along the coating path.

Preferably, the conveying path has a generally arcuate shaped region immediately above the coating vessel. With this arrangement, as the pick-up mechanism moves along the arcuate shaped region of the conveying path, containers gripped by the pick-up mechanism move downwardly into the liquid coating material and subsequently upwardly out of the material. The arcuate shaped region of the conveying path is preferably arranged so that, as the pick-up mechanism moves through that region moving gripped containers out of the bath of liquid coating material, the pick-up mechanism initially withdraws the containers relatively rapidly until about two-thirds of the container height being coated is withdrawn from the bath of coating material and then withdraws the containers relatively slowly until they are finally withdrawn from the material.

The conveying path is preferably endless. Moreover the conveying means preferably includes an endless conveying member movable along the conveying path. The pick-up mechanism is preferably connected to the conveying member for movement therewith.

Preferably, the pick-up mechanism is operable to continue to hold the containers in stable suspension during setting by the setting means of at least part of the coating applied to the containers. The pick-up mechanism may operate to release the containers after a part only of the coating applied to the containers has been cured, depending on whether single or multi-stage curing is utilized.

The setting means may comprise or include curing emans to cure the liquid coating material applied to the containers.

Preferably, the curing means includes radiation means operable to generate electro-magnetic radiation which irradiate the coating applied to the containers. The radiation means preferably includes one or more radiation units. In multi-stage curing two or more units may operate in succession so as to each irradiate the coating applied to containers to cure a part of the coating. These radiation units may be positioned one each upstream and downstream of a release position of the containers from the pick-up mechanism. The upstream radiation unit preferably irradiates the coating to cure a part of the coating while the containers are gripped. The downstream radiation unit may then irradiate the coating to cure a remaining part of the coating after the containers are released. In alternative single-stage curing one or more (such as two) radiation units may operate together to irradiate the coating applied to the containers.

The seating means may include heating means for at least assisting in the removal of volatile ingredients from the coating applied to the containers. Where the heating means is used in conjunction with the curing means then preferably the heating means is located upstream of the curing means.

The heating means preferably includes a heating chamber connectable to a source of heated gas. The conveying means preferably extends through the heating chamber to move the containers therethrough and subject the applied coating to heating by the heated gas.

The following description refers to preferred embodiments of the method and apparatus of the present invention. To facilitate an understanding of the invention, reference is made in the description to the accompanying drawings where the apparatus is illustrated. It is to be understood that the invention is not limited to the embodiments as hereinafter described and as illustrated.

DESCRIPTION OF THE DRAWINGS

FIG. 8 is a cross-sectional view through Section VIII—VIII of the pick-up mechanism of FIG. 6;

FIG. 9 is a cross-sectional view through Section IX—IX of the pick-up mechanism of FIG. 6;

DESCRIPTION OF THE PREFERRED EMBODIMENTS

Figure 1:
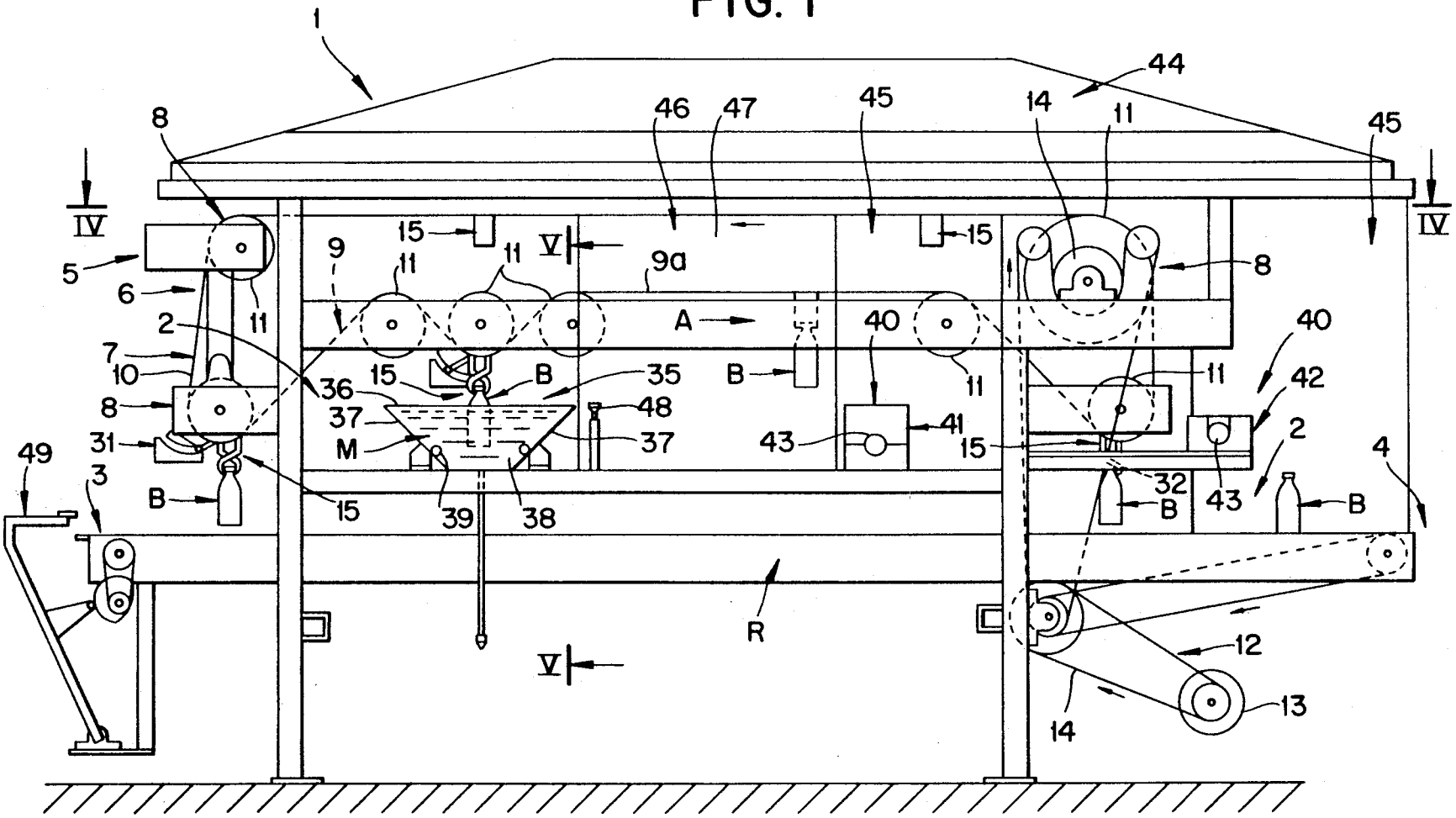
FIG. 1 is a general side view of a coating apparatus according to a preferred embodiment of the present invention.
Figure 2:
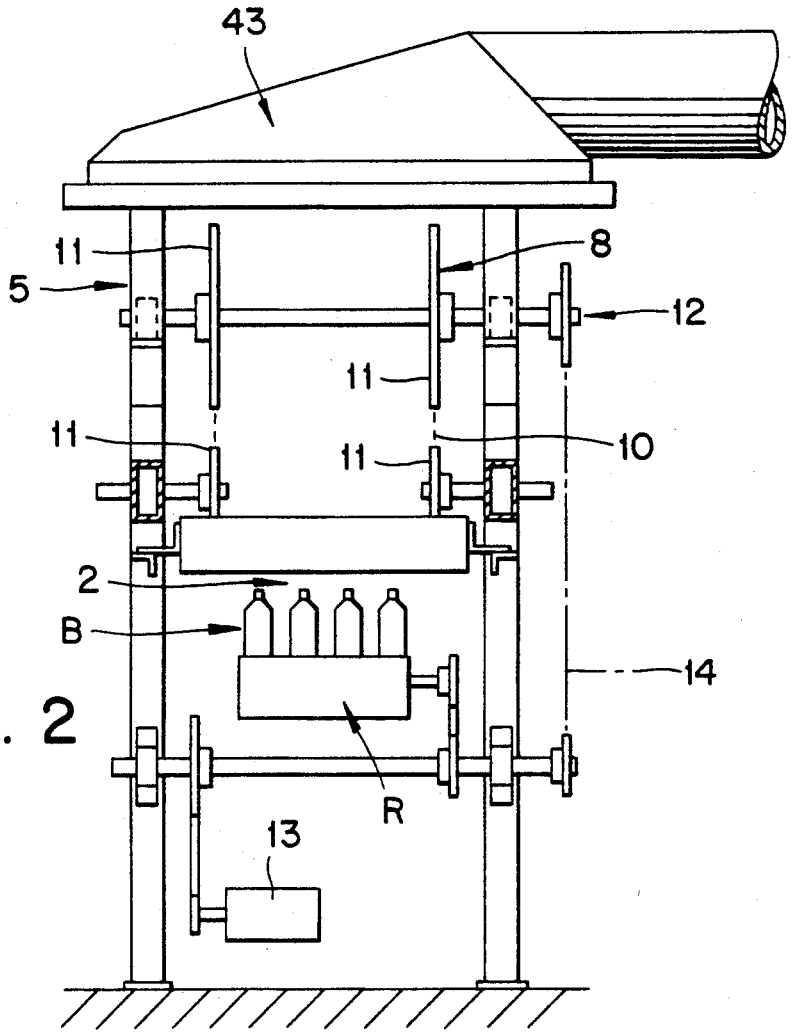
FIG. 2 is one end part view of the apparatus of FIG. 1.
Figure 3:
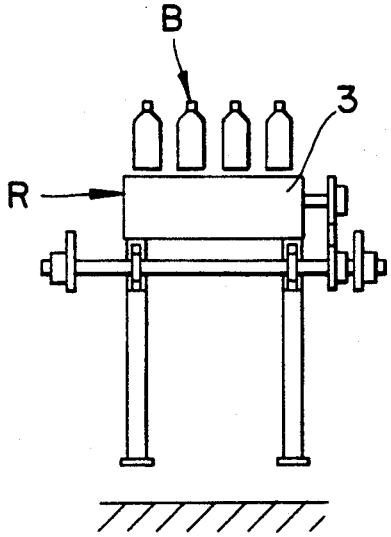
FIG. 3 is an opposite end part view of the apparatus of FIG. 1.
Figure 5:
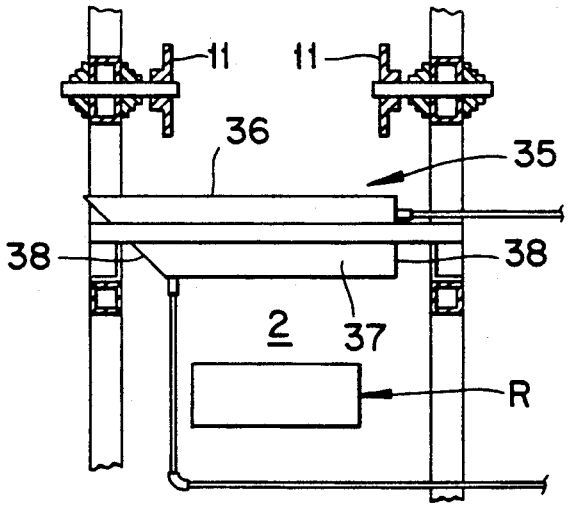
FIG. 5 is a cross-sectional view through Section V—V of the apparatus of FIG. 1.
Figure 4:
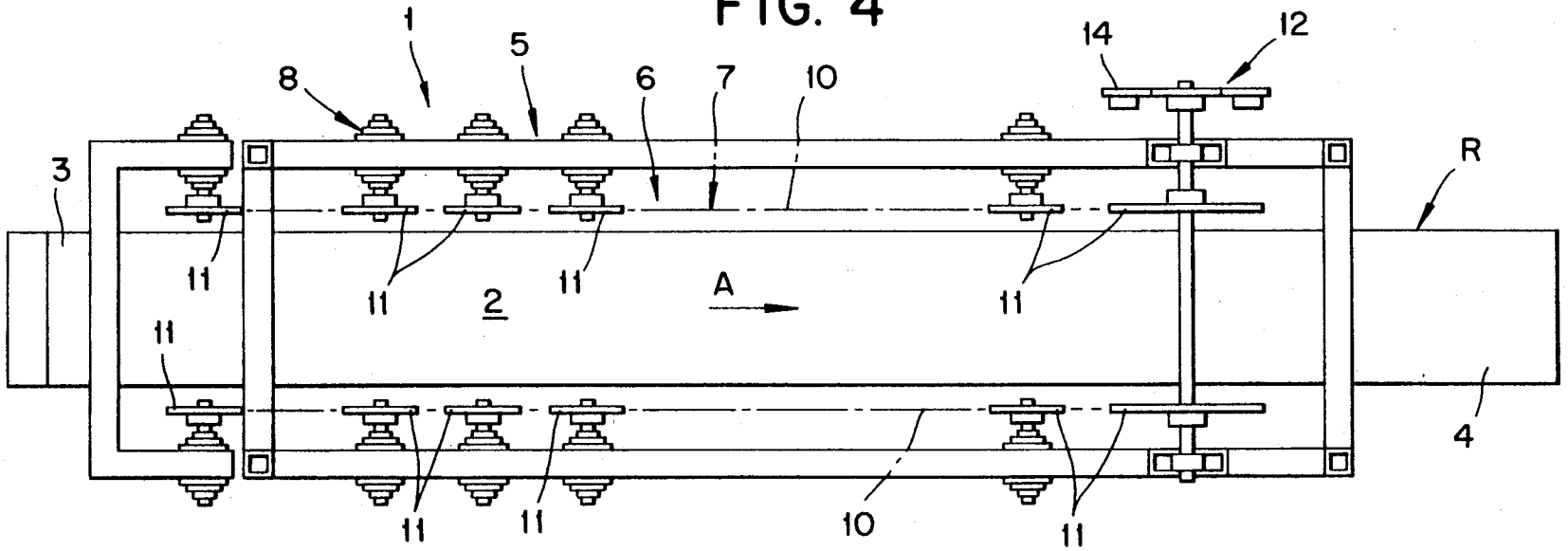
FIG. 4 is a plan part view through Section IV—IV of the apparatus of FIG. 1.
Figure 7:
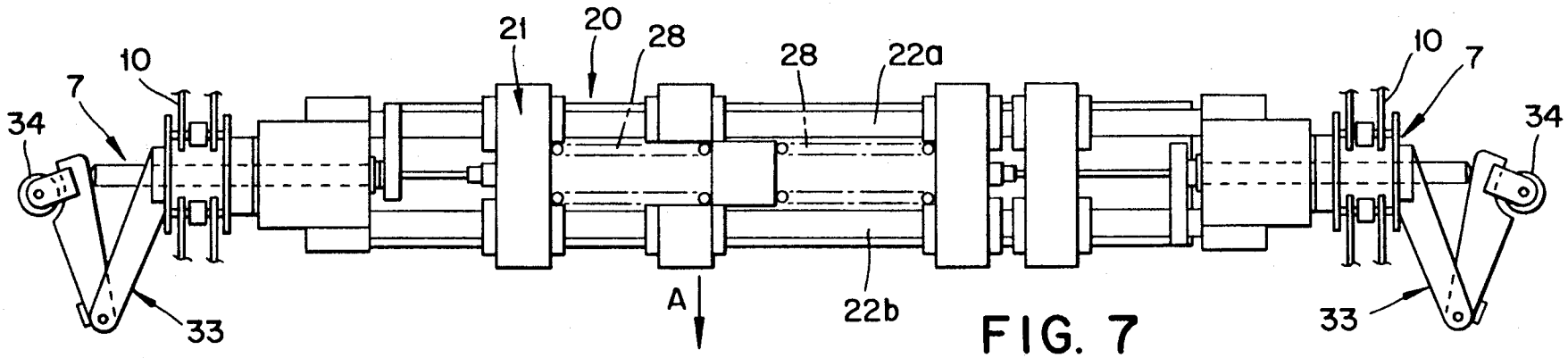
FIG. 7 is a plan view of the pick-up mechanism of FIG. 6.
Figure 6:
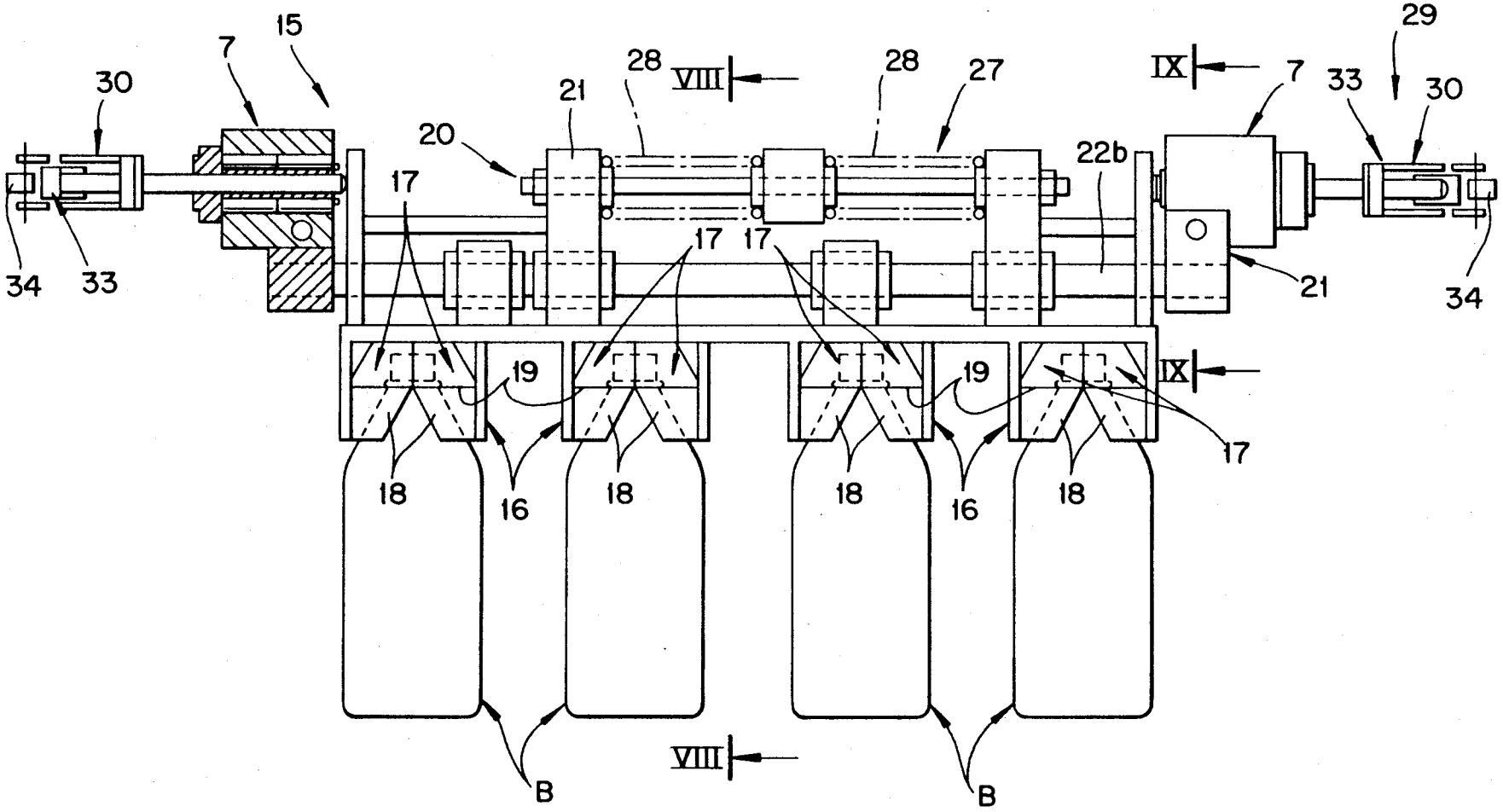
FIG. 6 is a side view of one preferred pick up mechanism of the coating apparatus of FIG. 1.
Figure 10:
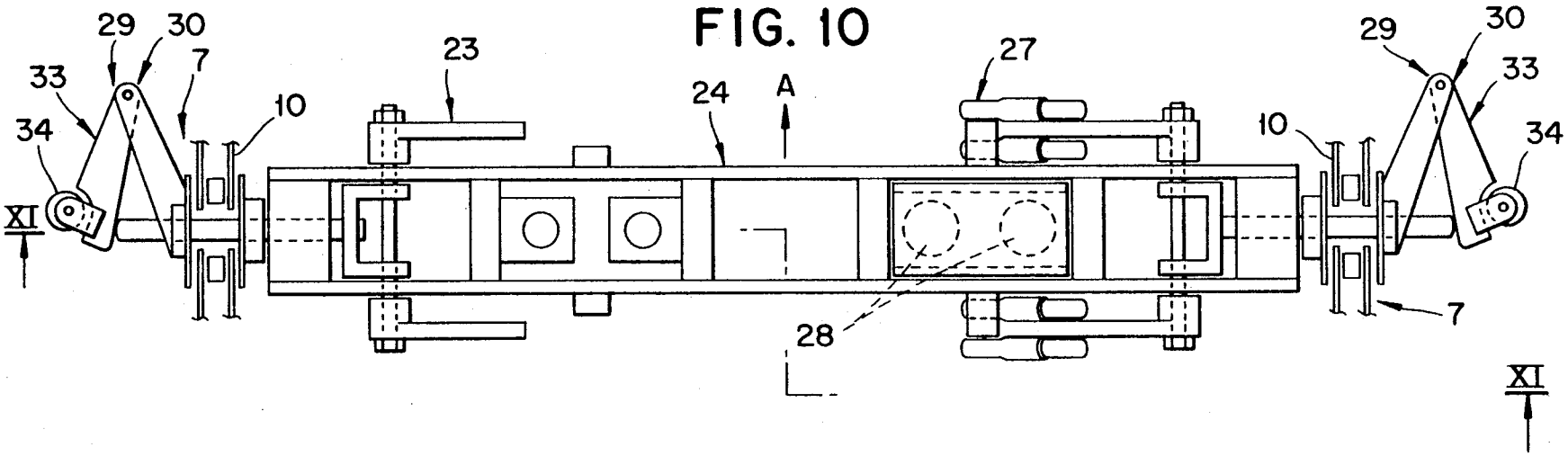
FIG. 10 is a plan view of another preferred pick-up mechanism of the coating apparatus of FIG. 1.
Figure 11:
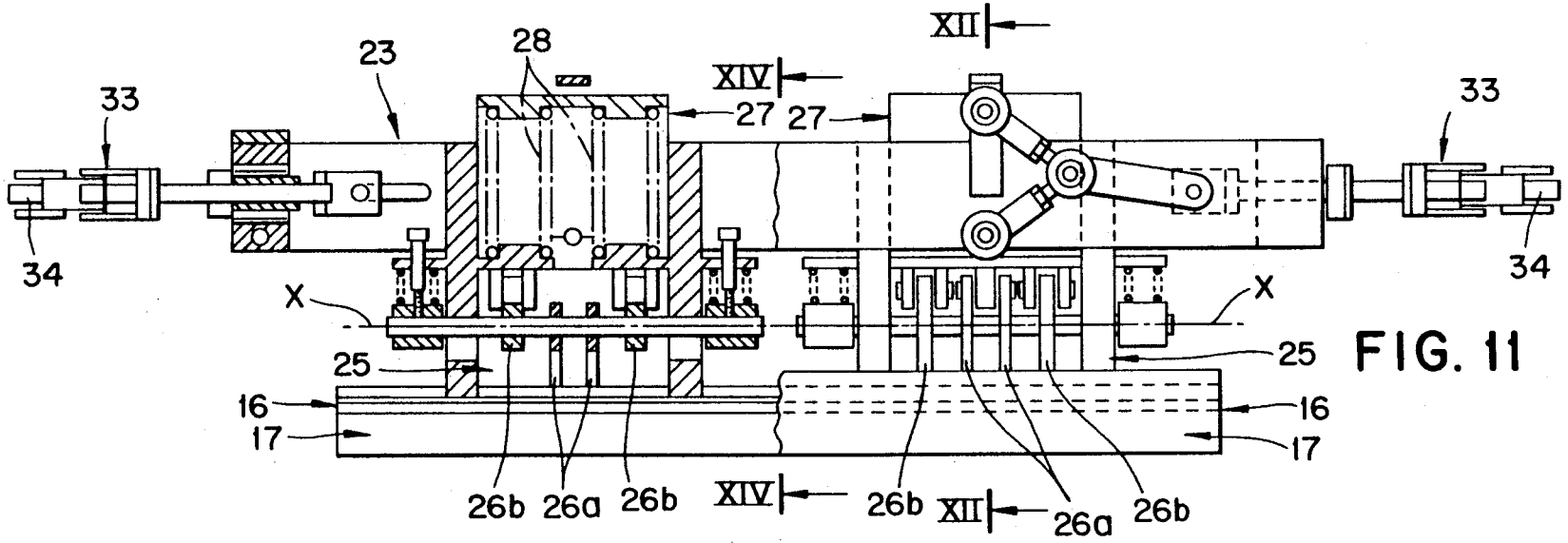
FIG. 11 is a part cross-sectional view through Section XI—XI of the pick-up mechanism of FIG. 10.
Figure 14:
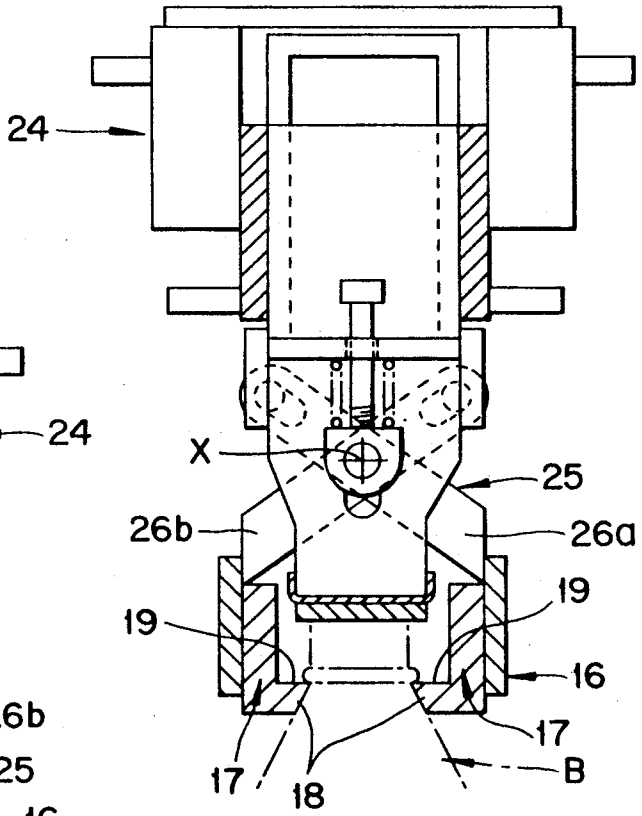
FIG. 14 is a cross-sectional view through Section XIV—XIV of the pick-up mechanism of FIG. 11, with the mechanism in a closed position.
Figure 13:
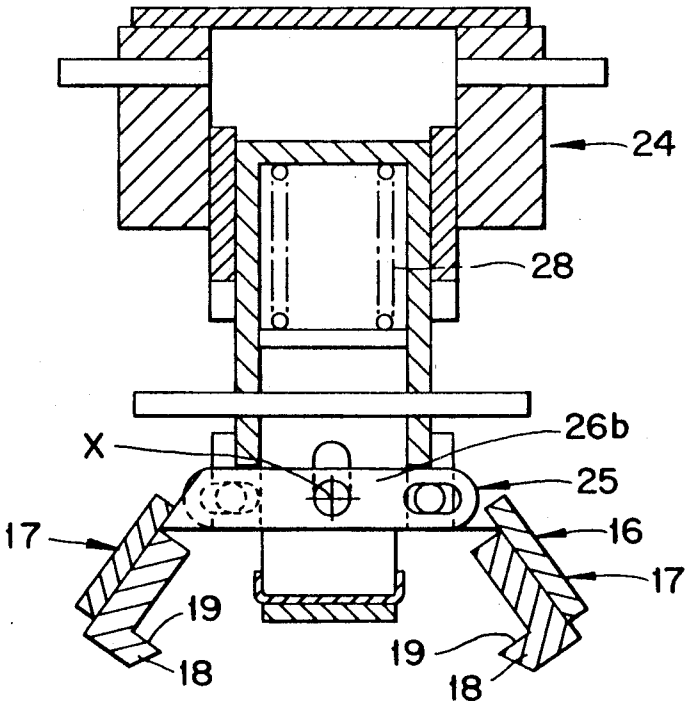
FIG. 13 is a similar view to that of FIG. 12, but with the pick-up mechanism in an open position.
Figure 12:
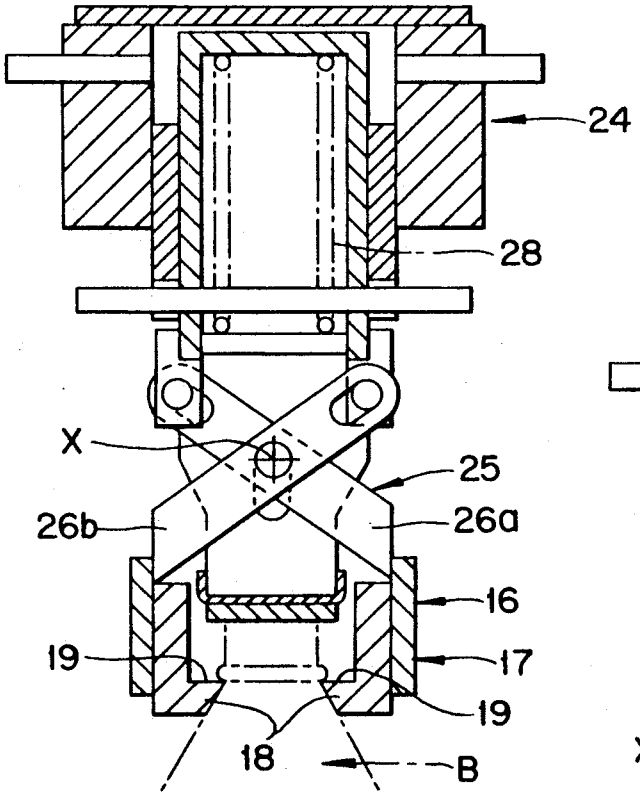
FIG. 12 is a cross-sectional view through Section XII—XII of the pick-up mechanism of FIG. 11, with the mechanism in a closed position.

Referring to the drawings, and in particular to FIGS. 1 to 5, and 16 there is generally shown coating apparatus 1 for dip coating bottles B in a bath of liquid coating material M so as to apply a coating C to the outer surface thereof. Although this description refers to bottles B it should be appreciated that the method and apparatus are applicable to other glass containers and articles.

In this embodiment, the apparatus 1 is incorporated "in-line" with a bottle manufacturing line so that bottle coating occurs as part of the bottle manufacture. Conveniently, apparatus 1 is located in the manufacturing line so that coating occurs downstream of a container lehr (not shown). The apparatus 1 is located adjacent a lehr conveyor R so that bottles B are taken from the conveyor R, coated and subsequently replaced on the conveyor R without interruption or disruption to the bottle manufacturing line or process generally. In particular, movement of the bottles B along the conveyor R from the lehr, and otherwise upstream, need not be delayed for coating. It should be understood that the reference to the lehr conveyor R includes a lehr belt or a conveyor separate therefrom.

Although it is preferred that the method and apparatus be incorporated in-line so that pristine condition bottles are presented for coating, it is envisaged that the method and apparatus may also be used off-line for separate coating of bottles previously manufactured. Where this occurs, it is preferred that coating proceed within about 24 hours of manufacture, or at least before there is any bottle surface degradation that may adversely affect coating application. Further delays may require pre-treatment of the bottles B prior to coating. That pre-treatment may involve bottle cleaning and annealing to remove water or other impurities from the bottle surface.

In this embodiment, the bottles B may be presented to the apparatus 1 for coating with a bare glass outer surface. However, in an alternative embodiment, those bottles B may be hot-end treated so as to apply a tin coating to the outer surface, and over which the dip coating will be applied. That coating protects the glass outer surface and generally strengthens the bottles B. The tin coating will typically have a thickness of between 30 and 50 coating thickness units (ctu's).

In this embodiment, the bottles B are presented to the apparatus 1 in a controlled heated condition. As will become more apparent hereinafter this controlled temperature tends to improve coating, and in particular reduces the likelihood of the applied coating material M "running" on or "dripping" from the bottles B, and assists coupling between the coating material M and bottles B. Moreover, it is advantageously found that the time required for ageing of the coating C (as detailed hereinafter) prior to irradiation can be substantially reduced or eliminated.

In this embodiment, the bottles will be at a temperature of between about 50° and 150° C., and in one particular embodiment will be at a temperature of about 100° C. Typically, the bottles B will exit from the lehr at a temperature of about 140° C., so that the temperature of the bottles may be controlled by bottle heating or cooling as required prior to presentation to the apparatus 1. The ability to use the heated condition of the bottles B as they exit from the lehr is a further advantageous reason for coating the bottles "in-line" during their manufacture.

In the apparatus 1, the bottles B are conveyed continuously along a coating path 2 in the direction of arrow A from an entry zone 3 to an exit zone 4. Those zones 3,4 are spaced apart along the lehr conveyor R. Moreover, the bottles B are conveyed in a line formation between the entry and exit zones 3,4. That line may be composed of individual bottles B arranged one behind the other (not shown). Alternatively (as shown), lateral rows of bottles B may be arranged one behind the other to form the line. The number of bottles B in the rows may vary. As shown, four (4) rows of bottles B are provided, but rows of up to about forty-eight (48) bottles B are envisaged depending on the capacity of the bottle manufacturing line.

Conveyance of the bottles B along the coating path 2 includes collecting the bottles B at the entry zone 3 and depositing them at the exit zone 4. Collecting the bottles B includes picking them up from the lehr conveyor R, whilst depositing the bottles B includes putting them back down on the conveyor R.

To achieve this conveyance, the apparatus 1 includes conveying means 5 having a conveying mechanism 6. That mechanism 6 includes an endless conveying member 7 mounted on support members 8 and movable continuously along a conveying path 9, a section 9*a* of which extends along the coating path 2. The conveying member 7 may be a conveying belt (not shown), or a pair of parallel, spaced apart chains 10 mounted on paired sets of support pulleys, wheels or sprockets 11 (as shown).

The conveying mechanism 6 also includes a drive unit 12 for moving the conveying member 7 along the conveying path 9. That drive unit 12 includes a drive motor 13, such as an electric drive motor, coupled to the conveying member 7 either directly (not shown) or through a suitable belt and pulley or chain and sprocket drive transmission 14 (as shown).

The conveying means 5 also includes at least one bottle pick-up mechanism 15 connected to the conveying member 7 for movement therewith, and operable to pick up the bottles B at the entry zone 3, carry them along the coating path 2 during coating, and put the coated bottles B down toward the exit zone 4. Each pick-up mechanism 15 holds the bottles B at an upper region U thereof so that they generally depend from the mechanism 15 for dipping into the bath of coating material M. That upper region U is not coated, an upper line L of coating embodiment, the pick-up mechanism 15 holds the bottles B adjacent the finish F thereof. In one particular embodiment, the bottles B are held by a neck N immediately beneath the finish F. It will be appreciated that other containers and articles may be held at different upper regions U.

As shown, a series of pick-up mechanism 15 are connected in spaced apart relation along the conveying member 7. In this way, as each mechanism 15 in turn moves through the entry zone 3, it can operate to pick-up the next in line bottle(s) at the entry zone 3. Where rows of bottles B are arranged in line, as in this embodiment, then each mechanism 15 will operate to pick up the next in line row of bottles B.

The speed of movement of the conveying member 7 is selected so that the bottles B at the entry zone 3 are picked up by passing pick-up mechanisms 15 at a rate about equal to their rate of arrival at the entry zone 3. In this way, bottles B moving downstream from the lehr are not unduly delayed in their manufacturing process. The speed may be set so that the bottles B move at between about 200 and 600 bottles per minute, when arranged in lateral rows of between about 22 and 48 per row. Thus, between about 9 and 13 rows of bottles are moved along the coating path 2 per minute.

Each pick-up mechanism 15 releasably grips each bottle B at the upper region U. That gripping is sufficient to hold the bottles B stable for dipping in the bath of coating material M. In particular, the mechanism 15 is capable of holding the bottles B in the coating material M against the buoyancy force applied by the material M.

Each pick-up mechanism 15 is of any suitable construction depending on the nature of the bottles B to be gripped. In this embodiment, each mechanism includes at least one pair of gripping members 16, the members 16 of each pair being relatively movable toward and away from one another between a closed position for gripping a respective bottle B and an open position not gripping that bottle B. Each pick-up mechanism 15 is mounted on the conveying member 7, and the conveying part section extending along the coating path 2 is configured such that, as the pick-up mechanism 15 enters the entry zone 3, the gripping members 16 are automatically orientated so as to align themselves with respective bottles B in the entry zone 3, and move about upper regions U of those bottles for gripping. Moreover, as each pick-up mechanism 15 approaches the exit zone 4, the gripping members 16 are automatically orientated so as to carefully place gripped bottles back on the lehr conveyor R.

Adjacent pairs of gripping members 16 are spaced apart a sufficient distance so that gripped bottles B are spaced from one another. In this embodiment, bottle spacing is of the order of about 40 mm.

The gripping members 16 include gripping fingers 17. Those fingers 17 have gripping portions 18 that contact the bottles during gripping, the gripping portions 18 being composed of rigid material and contoured or otherwise shaped, or being composed of resiliently flexible material for deforming, to mate with the upper region U of the bottles B for stable gripping thereof. In this embodiment, the gripping portions 18 are shaped or deformed so as together fit neatly about a bottle neck N and provide a support shoulder 19 on which the bottle finish F bears. The gripping fingers 17, or at least the gripping portions 18, where rigid may be removable and replaceable for holding differently shaped containers and articles.

The gripping fingers 17 are movable in any suitable manner. In that regard, those fingers 17 are linearly or pivotably movable toward and away from one another in alternative embodiments shown in detail in FIGS. 6 to 9 and FIGS. 10 to 14 of the drawings, respectively.

In one embodiment shown in drawing FIGS. 6 to 9, each pick-up mechanism 15 includes an elongate carriage 20 mounted on the conveying member 7 and to which the gripping fingers 17 are movably connected.

Each carriage 20 includes an elongate frame 21 connected to the conveying member 7 so as to extend transversely of the direction of movement, arrow A and a pair of support shafts **22*a*, 22*b* mounted in the frame 21 for longitudinal sliding movement relative to the frame 21. Individual gripping fingers 17 of each pair are fixed one each to respective shafts 22*a*, 22*b* so that sliding movement of the shafts 22*a*, 22*b* in opposite directions linearly move the fingers 17** of each pair relative to one another between their open and closed positions.

In another embodiment, shown in drawing FIGS. 10 to 14, each pick-up mechanism 15 includes an elongate carriage 23 mounted on the conveying member 7 and to which the gripping fingers 17 are movably connected.

Each carriage 23 includes an elongated frame 24 mounted on the conveying member 7, and a respective scissor linkage 25 mounted on the frame 24. Each linkage 25 has at least one pair of links **26*a*, 26*b* each rigidly connected individually to one gripping finger 17 of each pair. Relative pivotal movement of the links 26*a*, 26*b* in a "scissor" action about pivot axis X causes the gripping fingers 17** to pivot relative to one another between their open and closed positions.

Each pick-up mechanism 15 also includes drive means 27 for selectively moving the fingers 17 to their open and closed positions.

In the two embodiments shown, the fingers 17 are biased into one of those positions, and movable against that bias into the other position. That bias is a resilient bias. To that end, the drive means 27 includes one or more biasing springs 28 for biasing the gripping fingers 17. That bias is into the closed position in these embodiments. Those biasing springs 28 act directly (not shown) or indirectly (as shown) on the gripping fingers 17. In that regard, the springs 28 act on a carriage component such as between the frame 21 and support shafts **22*a*, 22*b* in the embodiment shown in drawing FIGS. 6 to 9, or between the frame 25 and scissor linkages 26 in the embodiment shown in drawing FIGS. 10 to 14**.

The drive means 27 also includes a drive arrangement 29 for moving the gripping fingers 17 to their open position ready for gripping bottles B at the entry zone 3 and for subsequently releasing those bottles B toward the exit zone 4. The drive arrangement 29 is of any suitable construction.

In the two embodiments shown, the drive arrangement 29 utilizes the movement of the pick-up mechanism 15 to generate the opening movement. In that regard, the drive arrangement 29 includes a cam and follower system 30 shown generally in FIG. 1 and in more detail in FIGS. 6 and 7, and FIGS. 10 and 11 of the drawings. The cam and follower system 30 comprises at least one cam 31, 32 fixed adjacent each of the entry and exit zones 3, 4, and at least one follower assembly 33 on each carriage 20 or 23. Each follower assembly 33 includes a follower element 34, which in this embodiment is a roller engageable with cams 31, 32. With this system 30, as each pick-up mechanism 15 moves toward the entry and exit zones 3, 4, each follower element 34 automatically engages with a respectively cam 31, 32, moving the follower assembly 33 responsively in order to effect gripping finger movement against the closing bias of the biasing springs 28.

Each follower assembly 33 acts directly (not shown) or indirectly (as shown) on the gripping fingers 17. In that regard, each assembly 33 can act on a carriage component such as the support shafts **22*a*, 22*b* or the scissor linkages 26. A single follower assembly 33 may be provided in each pick-up mechanism 15 to actuate all pairs of gripping fingers 17. Alternatively (as shown), a pair of such assemblies 33 may be provided each to actuate one or more gripping finger movement, and a pair of cams 31, 32 may be fixed adjacent the entry and exit zones 3, 4, to engage with respective follower elements 34**.

The section 9*a* of the conveying path 9 extending along the coating path 2 is configured such that bottles B held by the pick-up mechanisms 15 move downwardly into the bath of liquid coating material M in a dipping action. Conveying path section 9*a* adjacent the baths of coating material M is of a generally arcuate shape so that as the pick-up mechanism 15 moves along the section 9*a*, gripped bottles B are moved into and out of the bath of coating material M. The bottles B move along the coating path 2 whilst in the bath. The coating path 2 is adjustable so that the rate of dipping into the bath of liquid coating material, the time of maximum immersion and the rate of withdrawal from the bath may be varied to obtain the coating thickness desired. Adjustment of the coating path may include adjustment of the conveying path 9, and in particular section 9*a* adjacent the bath of coating material M.

The period of bottle dipping may vary according to the nature and shape of the bottles B as well as the composition of the coating material M and the coating desired. In general terms, dipping will occur for a period sufficient to apply an acceptable coating C to those bottles. In this embodiment the dipping period is of the order of about 10 seconds in order to produce a uniform coating of between about 3 and 5 microns in thickness (after curing) on the bottles, although a coating thickness of up to about 10 microns (after curing) may be applied about the heel H and across the base O of each bottle B. This added thickness assists in protecting the bottles B during subsequent use.

Depending on the coating material M used, the quality of coating C may be influenced by the rate at which the bottles B move into and/or out of the bath of coating material M. In particular, the rate of bottle vertical withdrawal from the material M can be important, with too rapid a rate of withdrawal causing an uneven coating thickness and coating drips. Withdrawal speed controls the thickness of the coating material M, with fast speeds dragging more material out of the bath with the bottles B, and slow speeds dragging less material out and allowing more fun-off of excess material to occur. In this embodiment, it has been found advantageous to withdraw the bottles B from the bath of coating material M in two stages of differing speeds. In that regard, the bottles B undergo a first, relatively fast withdrawal stage until about two-thirds ($\frac{2}{3}$) of the bottle height being coated is withdrawn from the bath of coating material. This is followed by a second slower withdrawal stage during which the bottles B are finally withdrawn. The first stage tends to avoid insufficient coating material applied on the bottles B, whilst the second stage minimizes coating material drips or runs at the base of the bottles B.

Bottle immersion time and rate of bottle withdrawal from the bath of coating material M can be adjusted by locally varying the generally arcuate shape of path section 9*a*, particularly immediately adjacent the bath of coating material M. This can be achieved by selecting and changing the number and/or relative size and/or relative location of the sprockets 11 supporting spaced apart chains 10 along section 9*a* of conveying path 9. One or more of the sprockets 11 may be variable in this manner. By so varying the sprockets 11, the angles at which the spaced apart chains 10 move along the path section 9*a*, and thus move the pick up mechanisms 15 along the path section 9*a*, can be changed relative to the underlying bath of coating material M as desired. It will be appreciated by those skilled in this art that the sprockets 11 are movably and/or removably mounted through any suitable mounting mechanism (not shown).

The apparatus 1 includes a vessel 35 for holding the bath of liquid coating material M. The vessel 35 is of any shape and size suitable for bottle dipping. The vessel 35 has an open top 36, a pair of side walls 37 and a pair of end walls 38. The side walls 37 extend transversely of the coating path 2 and converge downwardly from the open top 36 so that the end profile of the vessel 35 approximates the line of bottle movement through the bath of coating material M. This may minimize the amount of excess coating material M held in the vessel 35 during coating. The open top 36 may be partially closed or at least shielded to minimize ageing or curing of the coating material M therein, and thus extend bath life of that material M.

Although not shown in this embodiment, the vessel 35 may be of a "dual tank" configuration in which an inner tank is located within an outer tank. These tanks may be of a generally similar shape, but with the open top of the inner tank located slightly below a level of the open top of the outer tank. With this configuration, the inner tank is maintained filled to overflowing with the coating material M, so that the coating material M continuously flows from the inner tank into the outer tank from which it is subsequently removed. This enables a constant level of coating material M to be maintained within the inner tank. Moreover, surface waves on the coating material M caused by movement of the bottles through the material M are minimised.

Although not shown, the vessel 35 may be provided with drip and splash trays or guards for collecting any excess coating material M flowing from the dipped bottles or splashing from the vessel 35.

The apparatus 1 may provide for heating and/or cooling of the coating material M in the vessel 35. That is achieved by mounting one or more temperature control devices 39, such, as heating/cooling elements in or adjacent the vessel 35. The extent to which the coating material M is heated or cooled (if at all) by control devices 39 will depend on the nature and composition of the material M.

The coating material M is of any suitable composition. In preferred embodiments of the method and apparatus of the present invention suitable coating materials include the polymers as disclosed in Australian patent application 15269/88.

In one particular embodiment, the coating material M contains a methyl ethyl ketone (MEK) volatile thinning solvent. Accordingly, the bath of coating material M in the vessel 35 is maintained at a temperature below the evaporation or boiling point of the solvent. In this particular embodiment, the coating material M in the vessel 35 is maintained at an ambient temperature of up to about 30° C., whilst the bottles B are at a temperature of between about 80° C. and 100° C. as they enter the coating material M.

In this embodiment, the applied coating material M is cured by subjecting the material M to electro-magnetic radiation. The radiation, in this embodiment, is in the 0.2 to 10 micron wavelength region. In one particular embodiment, ultraviolet light radiation is used to achieve curing.

In some embodiments (as will become apparent hereinafter), it may be appropriate to subject the bottles B to a single stage radiation to achieve curing. However, in this embodiment multi-stage irradiation of the coated bottles B is used to ensure complete and uniform curing. In this embodiment, curing of at least the base O and heal H of the bottles B, through which those bottles bear on the unloading conveyor R is achieved whilst the bottles are still held by the pick-up mechanisms 15. In this way, the coating material M on the base O is not disturbed when the bottles B are subsequently released and placed on the conveyor R. Second and any subsequent stages of irradiation are conducted after the bottles B are released from the pick-up mechanisms 15, in this embodiment. This has an advantage of removing the mechanisms 15 as an obstruction to the irradiation.

Apparatus 1 subjects the bottles B to a two stage irradiation, a first stage directing radiation upwardly toward bottles B held by the pick-up mechanism 15, and a second stage directing radiation downwardly toward the bottles B after being put down by the pick-up mechanism 15.

The irradiation may involve reflecting the radiation about the bottles B to facilitate complete and uniform curing. Reflectors are used for that purpose, and they may be multifocus reflectors.

The intensity and the period of irradiation is selected to achieve satisfactory curing, and it will be appreciated by those skilled in the relevant art that the rate of curing depends of various factors including the coating material composition and its thickness on the bottles B, as well as the amount of irradiation applied to the coating material M. In this embodiment where two stage radiation is used, each stage subjects passing bottles B to irradiation for a period of up to about 15 seconds, although the first stage irradiation may be for a period of only about 1 second. The power and wavelength band of the radiation to which the bottles B are subjected is selected so that satisfactory curing of the coating material M occurs.

The apparatus 1 includes radiation means 40 operable to generate the energy rays. That radiation means 40 includes a radiation unit 41 for providing the first stage irradiation, and a radiation unit 42 for providing the second stage irradiation. These radiation units 41, 42 are rigidly mounted immediately below and above, respectively, the coating path 2. The radiation unit 41 directs radiation upwardly toward the bottles B to cure the coating C on the bottle base O, heel H and also partially cure the coating C on the bottle sides S, at least adjacent the base O. The radiation unit 42 directs radiation downwardly towards the bottles B to complete curing of the coating on the bottle sides S. Reflectors (not shown) may be included in the radiation units 41, 42 to reflect the radiation about the bottle sides S onto the coating material M.

Each radiation unit 41, 42, includes one or more lamps be mercury or metal halide discharge lamps, although other lamps are envisaged.

In this embodiment, provision is made for adequate ventilation of the coating path 2 in the regions of the radiation units 41, 42 to ensure that excessive ambient temperatures are not reached which could cause coating degradation. During curing, the bottles B will tend to heat up which, if not controlled, may cause cracking or crazing within the coating C. Ventilated air flow through the radiation unit regions of the coating path 2 has been found sufficient to moderate against excessive temperatures, in this embodiment.

Ventilation may be provided by a ventilation hood 44 extending above coating path 2 and through which is drawn surrounding air passing through the radiation unit regions of the coating path 2.

In addition, this embodiment may provide for sealing of the radiation unit regions or shielding of those regions from the coating path 2 in the region of coating material vessel 35. This sealing or shielding is to prevent radiation straying toward the vessel 35 and causing premature curing of bottle coatings C or curing of the coating material M within the vessel 35. This may be achieved by mounting sealing cabinets 45 about the radiation unit regions or shielding walls (not shown) between the radiation units 41, 42 and vessel 35.

In this embodiment, the method of the present invention further includes heating the coating material M applied to the bottles B being conveyed before that coating material M is subjected to curing. This initial heating step thermally ages the coating material, causing evaporation of volatile ingredients in the coating material and thereby facilitating subsequent curing of the material M. Where the coating material M includes a solvent it is important that the solvent be completely removed prior to curing, as residual solvent may adversely affect coating quality. In particular, the cured coating material may exhibit white markings where MEK solvent is retained during curing.

Heating of the coating material is achieved in any suitable manner. Bottles B exiting from the coating material M will have some retained heat and this may be sufficient to age the coating material. With this arrangement, the coating path 2 would be of a length that enabled the bottles B to age during their movement from vessel 35 to radiation unit 41. That may be constructionally appropriate and economically viable depending on bottle manufacturing line constraints and requirements. Where this is possible, then the location of the apparatus at the outlet of the lehr is particularly advantageous since the heated condition of the bottles B exiting from the lehr may inherently provide a suitable bottle temperature to achieve heating of the coating material.

In this embodiment of the method and apparatus, heat energy is applied to the coating material M by heating means 46 to facilitate ageing. In this embodiment, the heating means 46 involves applying hot gas, such as air, to the coating material M. That hot gas is supplied to a heating chamber 47 for circulation around the bottles B moving along the coating path 2 and passing through the chamber 47.

It is envisaged that in alternative embodiments, the heating means 46 could include heater devices (not shown) mounted adjacent the coating path 2 to direct heat energy to passing bottles B. The heater device(s) may include infra-red heater(s). Moreover, those heater device(s) may be used in conjunction with the hot gas drying chamber 47 applied to the coating material M.

The period of heating is selected to achieve satisfactory ageing and, again will vary depending on several factors. In this embodiment, a period of heating of up to about 15 seconds may be used. The temperature of the heat energy applied to the coating material during that period is selected so that satisfactory ageing will occur within the heating period.

The method and apparatus of the present invention may also include provision for removal of any coating material drip formations at the base O of the bottles B as they exit from vessel 35. That may be achieved by applying a jet or blast of hot gas, such as air, to the bottle bases O as they leave vessel 35 or enter heating chamber 47, the gas jet or blast separating the drips from the coating material. The gas jet or blast may be provided by a gas nozzle 48 mounted adjacent vessel 35 and connected to a source of hot gas.

In using the above described embodiment of the method and apparatus of the present invention, glass bottles B arrive at the entry zone 3 on a lehr conveyor R. If necessary, a stacker mechanism 49 may be located adjacent the entry zone 3 so as to arrange the bottles B individually or in rows, in a sequential line, ready for pick-up.

The conveying member 7 is continuously moving so that successive pick-up mechanisms 15 approach and pass through the entry zone 3. On entering that zone 3, each cam and follower system 30 of the respective mechanism 15 operate, through engagement of follower elements 34 with cams 31, to move respective gripping fingers 17 from their closed position to their open position. The gripping fingers 17 retain that position until they over lie and extend about the neck N of respective bottles B. The cam and follower systems 30 then immediately operate, through disengagement of follower elements 34 from cams 31, to allow the gripping fingers 17 to return to their closed position under biasing influence of springs 28 thereby gripping the bottles B.

The pick-up mechanism 15 and gripped bottles B are then moved by the conveying member 7 continuously along the coating path 2 toward the exit zone 4. During that movement, the bottles B are sequentially dipped in the bath of coating material M in vessel 35, exposed to heat energy in heating chamber 47 for thermal ageing, and exposed to ultraviolet light irradiation from radiation unit 41 for curing at least the base O.

The conveying member 7 then guides the bottles B back onto the lehr conveyor R. The cam and follower systems 30 of the pick-up mechanism 15 again operate to move the gripping fingers 17 to their open position, thereby releasing the bottles B onto the conveyor R.

The bottles B continue their movement along the conveyor R to the exit zone 4 and, during this movement, are exposed to radiation from radiation unit 42 for final curing of the coating material M.

The pick-up mechanism 15 continues its movement along the conveying path 9 to return to the entry zone 3 to pick up further bottles B.

Figure 15:
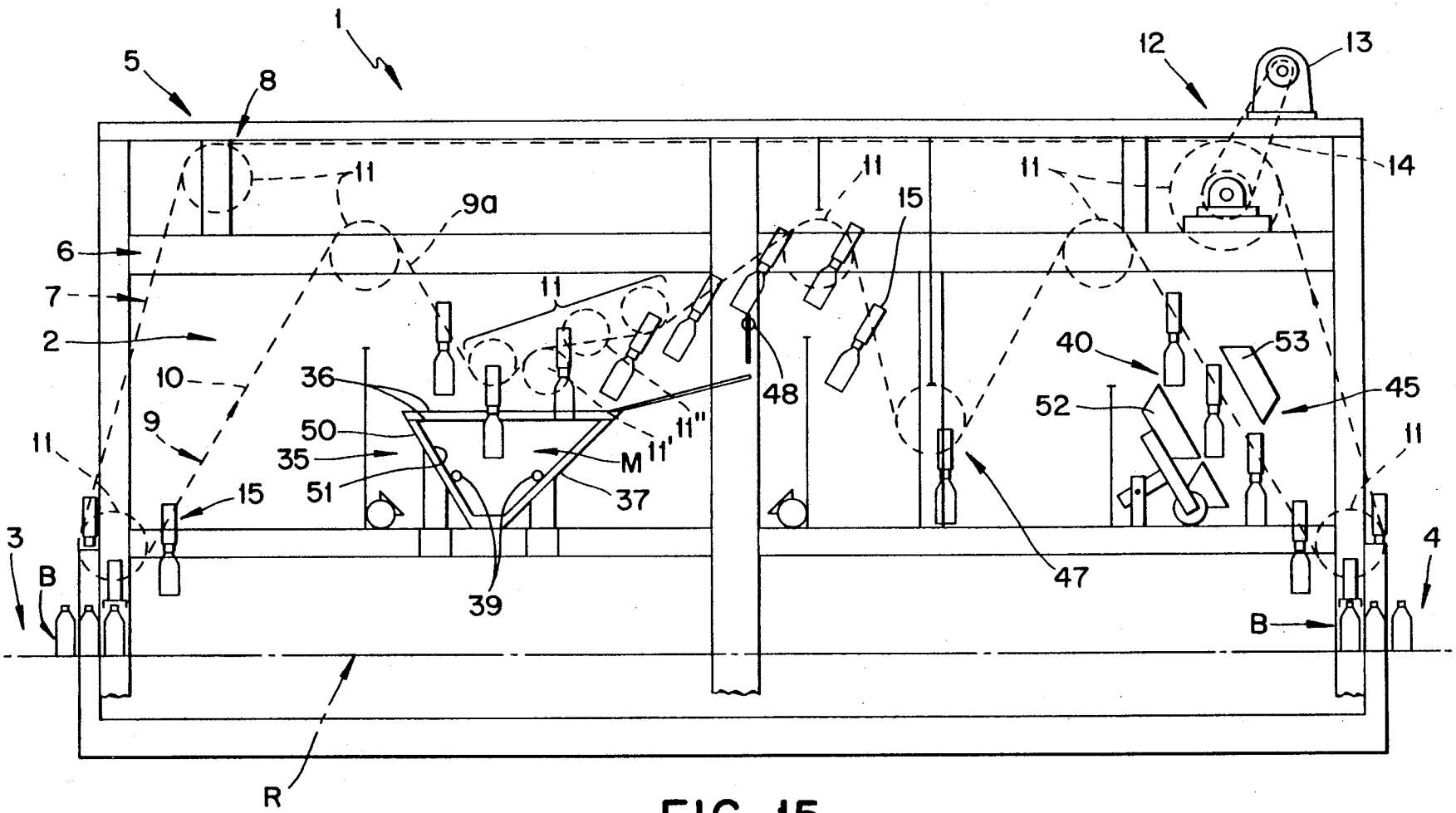
FIG. 15 is a general side view similar to FIG. 1 of a coating apparatus according to an alternative preferred embodiment of the present invention; and, FIG. 16 is a side view of a bottle coated using the apparatus and method of the present invention.
Figure 16:
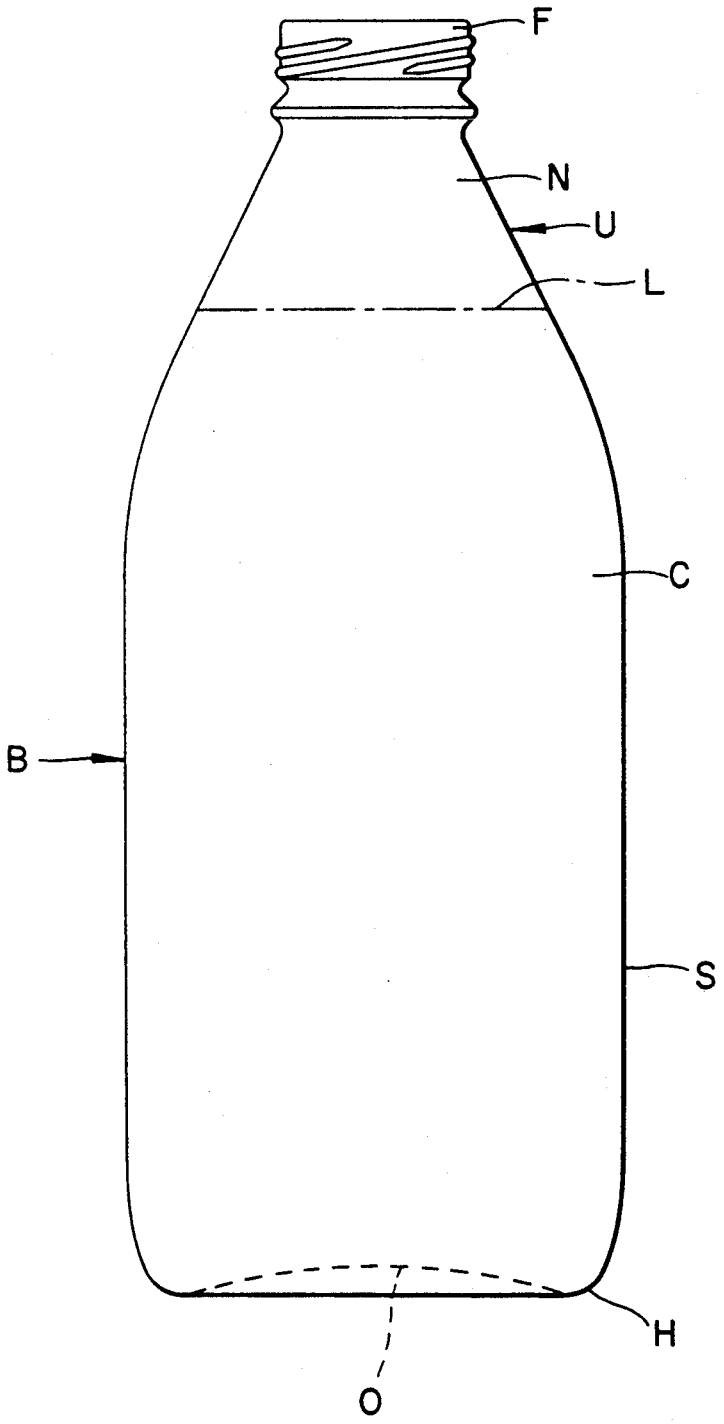

Referring now to FIG. 15, there is generally shown an alternative coating apparatus 1 for dip coating bottles B. This apparatus is similar to the apparatus previously described, with the same reference numerals being used to refer to the same or like components. To the extent that each apparatus 1 is the same or similar, the apparatus 1 of this embodiment will not be separately described.

In this embodiment, the conveying mechanism 6 again includes an endless conveying member 7 comprising a pair of spaced chains 10 mounted on paired sets of support pulleys, wheels or sprockets 11. One or more of the sprockets 11 located adjacent the bath of coating material M may be variable as with the previous embodiment. As shown in this embodiment, one sprocket 11 is mounted for movement between positions represented by sprockets marked 11' and 11''. This movement of that sprocket 11 will effect a change in the angle of movement of chains 10 passed vessel 35 and can be used to alter the bottle immersion time and rate of bottle movment through the bath of coating material M.

In this embodiment, vessel 35 is shown as a dual tank configuration, having an inner tank 50 and an outer tank 51. The open top 36 of the inner tank 50 is below the level of the open top 36 of the outer tank 51, so that the bath of liquid coating material M can fill to overflowing the inner tank 50. This enables the level of the coating material M to be maintained at a constant level within the inner tank 50.

In this embodiment, the bottles B are subjected to only a single stage irradiation to achieve curing. This irradiation occurs whilst the bottles B are held by the pick up mechanisms 15, and is provided by radiation means 40. Radiation means 40 comprises radiation units 52 and 53, arranged on opposite sides of the conveying path 9 so as to direct radiation toward bottles B passing therebetween. The radiation units 52 and 53, and bottles B are arranged relative to one another so that radiation unit 52 directs radiation upwardly at the base O and sides S of the bottles B whilst radiation unit 53 directs radiation downwardly onto the sides S of the bottles B. In this embodiment, the conveying path 9, as it passes between the radiation units 52 and 53, is angled downwardly, and the radiation units 52 and 53 are angled so as to direct radiation generally across the conveying path 9. With the bottles B suspended downwardly from the pick up mechanisms 15, the radiation is applied to the bottles B as outlined above.

Separate heating means 46 of the previous apparatus 1 is not shown in this embodiment of the apparatus, but may be provided as required. Heating of the coating material M, once applied to the bottles B, may be achieved in this embodiment by virtue of the retained heat within the bottles B.

The apparatus 1 of this embodiment incorporates gas nozzle 48 for removing residual drips of coating material M from the bottles B. To facilitate drip removal, apparatus 1 arranges for the drips to concentrate in a constant position on each bottle B as the bottle passes the gas nozzle 48. This is achieved by tilting the bottles B suspended from the pick up mechanisms 15 so that any excess coating material M forms a drip at the lower most region of the heel H of the bottles B. That tilting may be confined to immediately adjacent the gas nozzle 48, or may extend more generally along the conveying path section 9*a*.

Tilting of the bottles B may be achieved by any suitable arrangement. In that regard, although not shown in the FIG. 15 drawing, the pick up mechanisms 15 may be influenced by a tilting mechanism. The tilting mechanism may include a cam positioned for engagement by the pick up mechanisms 15, whereupon those mechanisms 15 move so as to tilt the bottles B.

In using this alternative embodiment of the method and apparatus of the present invention, glass bottles B again arrive at the entry zone 3 for pick up by successive pick up mechanisms 15 to be moved continuously along the coating path 2 to exit zone 4. During that movement, the bottles B are sequentially dipped in the bath of coating material M in vessel 35, presented to the gas nozzle 48 for removal of any material drips formed thereon, passed through heating chamber 47 for thermal aging, and exposed to ultravoilet light irradiation from radiation units 52 and 53 for curing the coating material M. The conveying member 7 then guides the bottles B back onto the lehr conveyor R where the pick up mechanisms 15 release the bottles B.

The method and apparatus of the present invention is particularly suitable for incorporation into a bottle manufacturing line so that no separate after-manufacture handling of the bottles is required in order to apply the coating material. Moreover, the method and apparatus can be fully automatic so that there is no increase in direct manufacturing line labor costs. As such, the cost of applying the coating material may be minimized.

The method and apparatus of the present invention are found to be particularly effective in increasing the internal pressure and impact strength of bottles made by the blow-and-blow process as these are characterised by having very clean and strong inside surfaces. Bottles made by the press and blow process are subject to internal damage due to contact of the inside surface during the forming process by the pressing plunger and foreign particles. It is found that the strength of such bottles is not enhanced to the same extent by a coating applied according to the present invention. However, if a steam plunger system according to German patent Application P3820868.0 is used in the pressing process then these containers may also be substantially strengthened by a coating applied according to the present invention.

A further advantage of incorporating the method and apparatus in the bottle manufacturing line is that the bottles are received at the entry zone for coating in a very clean condition. Such a condition facilitates application of the coating material and enhances coupling between the bottles and coating material. In contrast, off-line use of the method and apparatus may involve a treatment of the bottles prior to coating application.

The method and apparatus of the present invention can produce a uniform coating on bottles. Moreover, the coating can be accurately applied to exterior surfaces so that interior surfaces and finishes remain coating free. This is achieved even though coating occurs on a continuous basis during bottle manufacture.

The method and apparatus of the present invention provides for effective and economical use of the coating material. In that regard, dipping of the bottles minimizes material waste as might occur with, for example, spraying of the material onto the bottles.

The method and apparatus of the invention applies a coating material to individual bottles in such a way that those bottles do not touch each other, and the coating material is not disturbed such as by contact therewith, until curing of the coating material occurs. As a result, uniformity and integrity of the coating material is maintained.

Finally, it is to be appreciated that various modifications and/or additions may be made to the method and apparatus without departing from the ambit of the present invention as defined in the claims appended hereto.

We claim:

1. A method for coating exterior surfaces of rows of heated glass containers exiting continuously from a lehr at a controlled temperature on a lehr conveyor, comprising the steps of:

(i) gripping each row of containers in succession at an upper region thereof;

(ii) picking the row of gripped containers up form the lehr conveyor so as to hold the containers in upright stable suspension;

(iii) conveying the gripped row of containers along a coating path located above the lehr conveyor so that the containers are arranged in a non-contact relationship with one another;

(iv) dipping the row of containers being conveyed at least partially into a bath of ultraviolet light radiation curable liquid coating material so as to apply a coating of the coating material to exterior surfaces of the containers;

(v) withdrawing the row of containers with the applied locating from the bath of liquid coating material;

(vi) thermally aging the applied coating while continuing the convey the coated containers along the coating path;

(vii) subjecting the coated containers being conveyed along the coating path to irradiation with ultraviolet light radiation so as to cure the coating, the containers being maintained in upright stable suspension throughout irradiation thereof;

(viii) repositioning the gripped row of coated containers onto the lehr conveyor downstream from where the containers were picked up;

(ix) releasing the grip on the row of coated containers to return the containers to the lehr conveyor;

(x) said containers being conveyed continuously along the conveying path during steps iv, vi, and vii; and (xi) following withdrawal of the rows of containers from the bath of liquid coating material, tilting the suspended containers at an angle so as to cause any excess coating material to concentrate in a drip formation at a heel region of the containers, and the drip formation are blown from the containers with a gas blast.

* * * * *